US008311422B2

(12) United States Patent
Hirayama et al.

(10) Patent No.: US 8,311,422 B2
(45) Date of Patent: Nov. 13, 2012

(54) IMAGE FORMING APPARATUS HAVING A FIRST AND SECOND TONER CONTAINERS AND A DEVELOPING UNIT

(75) Inventors: Yushi Hirayama, Kanagawa (JP); Hitoshi Ishibashi, Kanagawa (JP); Tetsuya Muto, Kanagawa (JP)

(73) Assignee: Ricoh Company, Limited, Tokyo (JP)

( * ) Notice: Subject to any disclaimer, the term of this patent is extended or adjusted under 35 U.S.C. 154(b) by 324 days.

(21) Appl. No.: 12/566,137

(22) Filed: Sep. 24, 2009

(65) Prior Publication Data

US 2010/0092188 A1 Apr. 15, 2010

(30) Foreign Application Priority Data

Oct. 9, 2008 (JP) ..... 2008-262975

(51) Int. Cl.
*G03G 15/08* (2006.01)
*G03G 15/00* (2006.01)
*G03G 15/10* (2006.01)

(52) U.S. Cl. ..... 399/27; 399/49; 399/60

(58) Field of Classification Search ..... 399/27–30, 399/49, 60

See application file for complete search history.

(56) References Cited

U.S. PATENT DOCUMENTS 7,139,511 B2 11/2006 Ishibashi
7,228,081 B2 6/2007 Hasegawa et al.
7,251,420 B2 7/2007 Fujimori et al.
7,260,335 B2 8/2007 Kato et al.
7,305,195 B2 12/2007 Ishibashi
7,398,026 B2 7/2008 Ishibashi
7,477,856 B2 1/2009 Yoneda et al.
7,493,058 B2 2/2009 Takeuchi et al.
7,515,844 B2 4/2009 Tanaka et al.
7,526,219 B2 4/2009 Ishibashi
7,536,121 B2 5/2009 Shimizu et al.
7,546,046 B2 6/2009 Ishibashi
7,551,862 B2 6/2009 Tanaka et al.
7,551,864 B2 6/2009 Fujimori et al.
7,551,866 B2 6/2009 Watanabe et al.
2005/0063715 A1* 3/2005 Suzuki et al. ..... 399/27
2006/0274628 A1 12/2006 Tanaka et al.
2007/0025748 A1 2/2007 Ishibashi et al.
2007/0053703 A1 3/2007 Hirayama (Continued)

FOREIGN PATENT DOCUMENTS

JP 3041808 3/2000

(Continued)

OTHER PUBLICATIONS

U.S. Appl. No. 12/431,243, filed Apr. 28, 2009, Kayoko Tanaka, et al.

(Continued)

*Primary Examiner* — Joseph S Wong
(74) *Attorney, Agent, or Firm* — Oblon, Spivak, McClelland, Maier & Neustadt, L.L.P.

(57) ABSTRACT

An image forming apparatus includes a problem-occurrence determining unit, a problem-occurrence area determining unit, and a notifying unit. If the problem-occurrence determining unit determines that a problem has occurred in an image forming process, the problem-occurrence area determining unit determines whether the problem is caused by a toner filling process on the basis of toner-filling control data and toner-supply control data. The notifying unit then notifies the determination as to whether the problem is caused by the toner filling process.

5 Claims, 9 Drawing Sheets

U.S. PATENT DOCUMENTS

| | | | |
|---|---|---|---|
| 2007/0065164 | A1 | 3/2007 | Fujimori et al. |
| 2007/0098423 | A1 | 5/2007 | Hirayama et al. |
| 2007/0104499 | A1 | 5/2007 | Ariizumi et al. |
| 2007/0110457 | A1 | 5/2007 | Kato et al. |
| 2007/0116480 | A1 | 5/2007 | Takeuchi et al. |
| 2007/0269228 | A1 | 11/2007 | Takeuchi et al. |
| 2008/0025742 | A1 | 1/2008 | Kato et al. |
| 2008/0124107 | A1 | 5/2008 | Takeuchi et al. |
| 2008/0145078 | A1 | 6/2008 | Tomita et al. |
| 2008/0181670 | A1 | 7/2008 | Tsuda et al. |
| 2008/0205923 | A1 | 8/2008 | Takeuchi et al. |
| 2008/0253793 | A1 | 10/2008 | Ishibashi et al. |
| 2009/0110413 | A1 | 4/2009 | Takeuchi et al. |
| 2009/0162089 | A1 | 6/2009 | Ishibashi |
| 2009/0190960 | A1 | 7/2009 | Hirayama et al. |
| 2009/0202263 | A1 | 8/2009 | Yoshida et al. |

FOREIGN PATENT DOCUMENTS

| | | |
|---|---|---|
| JP | 2003-226063 | 8/2003 |
| JP | 3741691 | 11/2005 |
| JP | 2006-195281 | 7/2006 |
| JP | 2007-33770 | 2/2007 |
| JP | 2007-114429 | 5/2007 |
| JP | 2008-158373 | 7/2008 |

OTHER PUBLICATIONS

U.S. Appl. No. 12/482,782, filed Jun. 11, 2009, Akira Yoshida, et al.

* cited by examiner

IMAGE FORMING APPARATUS HAVING A FIRST AND SECOND TONER CONTAINERS AND A DEVELOPING UNIT

CROSS-REFERENCE TO RELATED APPLICATIONS

The present application claims priority to and incorporates by reference the entire contents of Japanese Patent Application No. 2008-262975 filed in Japan on Oct. 9, 2008.

BACKGROUND OF THE INVENTION

1. Field of the Invention

The present invention relates to an image forming apparatus.

2. Description of the Related Art

Japanese Patent Application Laid-open No. 2007-33770, Japanese Patent Application Laid-open No. 2006-195281, and Japanese Patent No. 3041808 disclose image forming apparatuses that adjust image forming conditions when a predetermined condition is satisfied, for example, immediately after the power of the image forming apparatus is turned on, or when the accumulated number of sheets fed for print output reaches a predetermined number. In an operation for adjusting the image forming condition, for example, light is emitted from a light emitting unit, such as a light emitting diode (LED), of an optical sensor and then reflected by the surface of a photosensitive element that functions as a latent image carrier or a transfer belt that functions as an image carrier. The amount of reflected light is then detected by a light receiving element of the optical sensor. After a reference toner image with a predetermined shape is formed on the surface of the photosensitive element, the amount of light reflected by the reference toner image formed on the surface of the photosensitive element or the transfer belt to which the reference toner image is transferred from the photosensitive element is detected by the optical sensor. The amount of toner adhering to the reference toner image per unit area is determined on the basis of the ratio between the amounts of reflected light and thus the image forming conditions for image forming processes are adjusted accordingly. The image forming conditions include the electric potential of a uniformly charged photosensitive element, developing bias, optical writing intensity for a photosensitive element, or a control target value of the toner density of a developer. The image density is controlled by adjusting the image forming conditions so that it is possible to print images with a stable image density over a long time.

Japanese Patent No. 3741691 and Japanese Patent Application Laid-open No. 2007-114429 disclose image forming apparatuses that include a toner sub-container called a sub-hopper that is arranged along a toner conveying path for conveying toner from a toner cartridge to a developing unit. The toner cartridge contains toner to be supplied to the developing unit. Such an image forming apparatus performs an operation for supplying toner to the developing unit by a toner filling operation to temporarily fill a sub-hopper with toner fed from the toner cartridge and a toner supply operation to supply the toner contained in the sub-hopper to the developing unit depending on the requirements of the developing unit.

If a problem occurs in an image forming process during the operation for adjusting the image forming condition, the reference toner image is not correctly formed. The incorrectly formed reference toner image is detected by an optical reflection sensor. For example, if charging bias is turned off while developing bias is correctly turned on, solid images are formed on a whole surface with no image density adjustment; therefore, the optical reflection sensor detects abnormally dark images. If a mechanism for supplying toner from the toner cartridge to the developing unit cannot be operated, the toner is not supplied from the toner cartridge to the developing unit even though the toner contained in the developing unit has been consumed; therefore, the optical reflection sensor detects abnormally light images.

Although various phenomena can occur depending on a component that performs the image forming process or adjustment of image forming conditions, it is possible to determine, to some extent, that a problem has occurred in the image forming process by detecting a problem with the reference toner image. However, because it is difficult to determine the cause of the problem in the image forming process only by detecting a problem with the reference toner image, in a conventional image forming apparatus, maintenance personnel need to separately analyze whether each component that performs the image forming process is operating correctly or incorrectly after the problem is detected, whereby the problem can be resolved.

When a problem is detected in an image forming process performed by an image forming apparatus that includes a sub-hopper, a process for resolving the problem is performed as described below.

If a control unit determines that a problem has occurred in an image forming process on the basis of a detection result of a reference toner image, a notifying unit, such as an operation panel, notifies the user of the occurrence of the problem in the image forming process. The user then calls maintenance personnel, and the maintenance personnel analyze the cause of the problem and repair the part of the image forming apparatus that is causing the problem. In a conventional image forming process, maintenance personnel need to examine whether a problem has occurred in every part of the image forming apparatus that can affect the reference toner image. Therefore, even though a problem may have occurred in a toner-filling operation to fill a sub-hopper with toner, the maintenance personnel need to separately analyze whether each component of an image forming unit, such as a developing unit, arranged around a photosensitive element is operating correctly or incorrectly. Therefore, it takes a long time for the maintenance personnel to determine that the problem has occurred in the toner filling process, resulting in a long downtime during which the maintenance personnel repair the image forming apparatus and the user cannot use the image forming apparatus.

SUMMARY OF THE INVENTION

It is an object of the present invention to at least partially solve the problems in the conventional technology.

According to an aspect of the present invention, there is provided an image forming apparatus including a latent image carrier configured to carry an electrostatic latent image; a latent-image forming unit configured to form an electrostatic latent image on the latent image carrier; a developing unit configured to develop the electrostatic latent image formed on the latent image carrier into a toner image by applying toner to the electrostatic latent image; a first toner container configured to contain therein toner to be supplied to the developing unit; a second toner container that is located along a toner conveying path for conveying toner from the first toner container to the developing unit, wherein the second toner container temporarily holds toner conveyed from the first toner container and feeds the toner to the developing unit; a toner-filling control unit configured to control a toner filling operation for supplying toner from the first toner container to the second toner container so that the second toner container contains toner equal to or more than a predetermined amount of toner; a toner-supply control unit configured to control a toner supply operation for supplying toner from the second toner container to the developing unit depending on requirements of the developing unit; a reference toner-image detecting unit configured to detect a reference toner image that is a toner image with a predetermined shape formed on any one of the latent image carrier and an image carrier to which the toner image is transferred from the latent image carrier; an image-density control unit configured to control image density by adjusting an image forming condition in accordance with a detection result obtained from the reference toner-image detecting unit; a problem-occurrence determining unit configured to determine whether a problem occurs at some stage of an image forming process in accordance with the detection result; a problem-occurrence area determining unit configured to, if the problem-occurrence determining unit determines that the problem has occurred, determine whether the problem is caused by the toner filling process on the basis of toner-filling control data on the toner filling operation and toner-supply control data on the toner supply operation; and a notifying unit configured to notify a determination obtained by the problem-occurrence area determining unit as to whether the problem is caused by the toner filling process.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments of the present invention are explained in detail below with reference to the accompanying drawings.

Although an image forming apparatus according to an embodiment of the present invention is explained as a copier, the image forming apparatus can be a printer, a facsimile machine, or the like.

Figure 1:
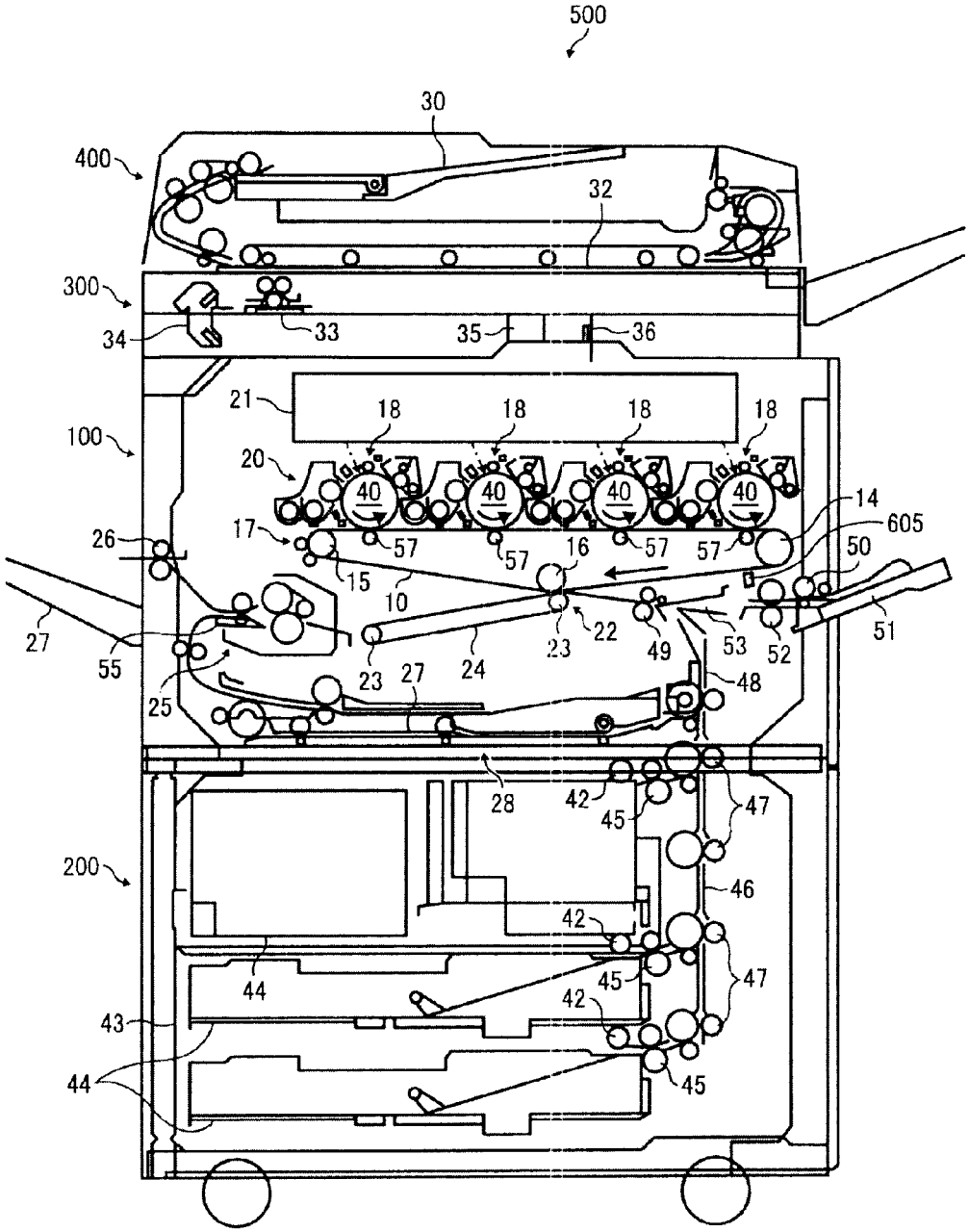
FIG. 1 is a schematic diagram of a copier according to an embodiment of the present invention.

FIG. 1 is a schematic diagram of a copier 500 that is a color copier as an example of a color image forming apparatus according to the embodiment.

The copier 500 includes a printer unit 100, a feed unit 200, a scanner 300, and an automatic document feeder (ADF) 400. The printer unit 100 is the main body of the copier 500 and is located in the middle of the copier 500. The feed unit 200 is in the form of a table and is located under the printer unit 100. The scanner 300 is located above the printer unit 100. The ADF 400 is located above the scanner 300.

The printer unit 100 includes an intermediate transfer belt 10 that is an endless flexible belt supported by a first supporting roller 14, a second supporting roller 15, and a third supporting roller 16. The intermediate transfer belt 10 functions as an image carrier. One of the supporting rollers 14, 15, and 16 is rotated by a drive unit (not shown) so that the intermediate transfer belt 10 is driven such that the surface of the intermediate transfer belt 10 is moved in the clockwise direction indicated by an arrow shown in FIG. 1. The other supporting rollers are rotated by the rotation of the one of the supporting rollers 14, 15, and 16. Four image forming units 18 are arranged side-by-side in the lateral direction on the upper support area of the intermediate transfer belt 10 supported by the first supporting roller 14 and the second supporting roller 15. The image forming units 18 form monochromatic images corresponding to black, cyan, magenta, and yellow. The image forming units 18 are located on the support area of the intermediate transfer belt 10 between the first supporting roller 14 and the second supporting roller 15, whereby a tandem image forming unit 20 is formed. An optical reflection sensor 605 is located on the support area of the intermediate transfer belt 10 between the first supporting roller 14 and the third supporting roller 16. The optical reflection sensor 605 detects the amount of toner adhering to an adherence control pattern that is a reference toner image formed on the intermediate transfer belt 10. The optical reflection sensor 605 functions as a reference toner-image detecting unit.

Figure 2:
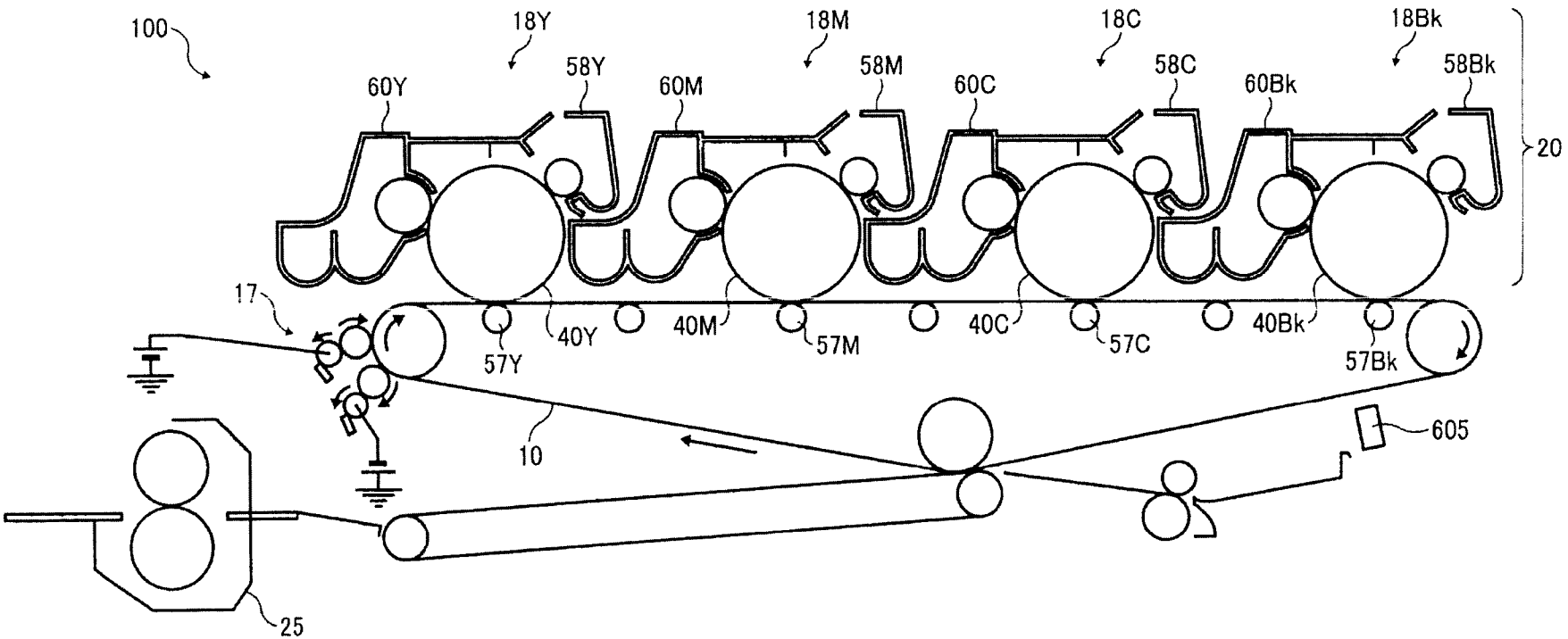
FIG. 2 is an enlarged view of a printer unit shown in FIG. 1.
Figure 3:
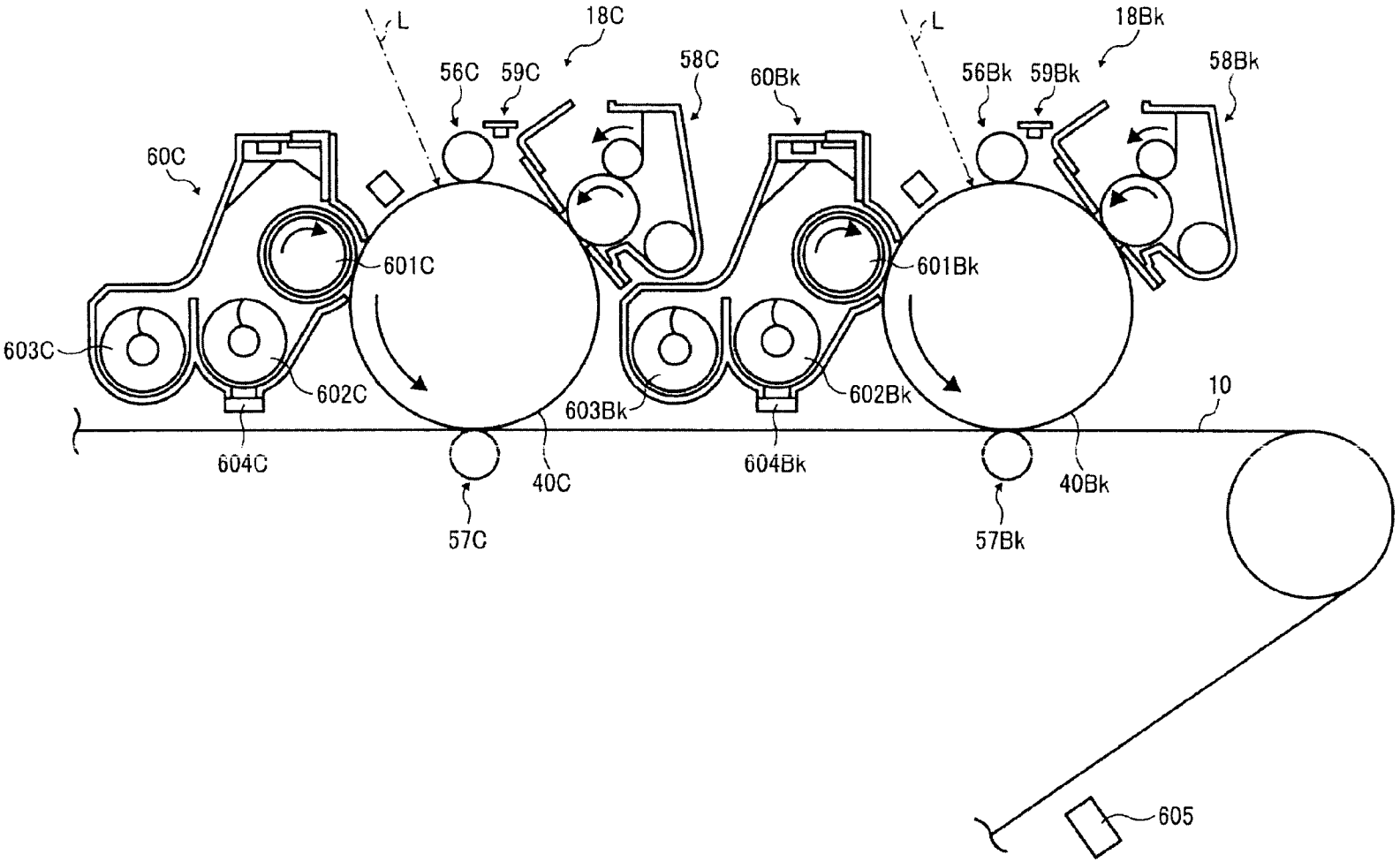
FIG. 3 is an enlarged view of two image forming units included in the printer unit.

FIG. 2 is an enlarged view of the printer unit 100. FIG. 3 is an enlarged view of the two image forming units 18 arranged on the downstream side of the intermediate transfer belt 10 in the moving direction of the surface of the intermediate transfer belt 10.

Each of the four image forming units 18 (18Bk: an image forming unit for black, 18C: an image forming unit for cyan, 18M: an image forming unit for magenta, and 18Y: an image forming unit for yellow) includes a photosensitive element 40 that is in contact with the surface of the intermediate transfer belt 10. The photosensitive element 40 functions as a latent image carrier. A charging unit 56, a developing unit 60, a cleaning unit 58, a neutralizing unit 59, and the like, are arranged around the photosensitive element 40. A primary transfer unit 57 is located on the inner side of the intermediate transfer belt 10 at a position where the photosensitive element 40 is in contact with the surface of the intermediate transfer belt 10. Although the four image forming units 18 have the same configuration, the image forming units 18 correspond to the four different colors, i.e., yellow, magenta, cyan, and black, of toner used in the respective developing units 60. As shown in FIG. 1, an exposure unit 21 is located above the image forming units 18 and functions as a latent-image forming unit. The exposure unit 21 irradiates the surface of each of the photosensitive elements 40 with a modulated laser light L, whereby an electrostatic latent image corresponding to each of the four colors is formed on the surface of the photosensitive element 40. The surface of the photosensitive element 40 between the charging unit 56 and the developing unit 60 is irradiated with the laser light L.

A secondary transfer unit 22 is located on the side of the intermediate transfer belt 10 opposite the tandem image forming unit 20. The secondary transfer unit 22 is arranged such that a secondary transfer belt 24 that is an endless belt is supported by two secondary-transfer belt supporting rollers 23 and the secondary transfer belt 24 is pressed against the third supporting roller 16 via the intermediate transfer belt 10. A fixing unit 25 is located on the left side of the secondary transfer unit 22 as shown in FIG. 1. The fixing unit 25 fixes toner images to a transfer sheet.

The secondary transfer unit 22 conveys a transfer sheet with images transferred thereon to the fixing unit 25. A non-contact charger can be used as the secondary transfer unit 22. In such a case, a transfer-sheet conveying unit needs to be separately configured to convey a transfer sheet with images transferred thereon to the fixing unit 25. In the example shown in FIG. 1, a transfer-sheet turnover unit 28 is located under the secondary transfer unit 22 and the fixing unit 25 in parallel to the tandem image forming unit 20. The transfer-sheet turnover unit 28 turns over a transfer sheet if images are to be transferred onto both sides of the transfer sheet.

When a copy operation is performed by the copier 500, an original is placed in an original tray 30 of the ADF 400. Alternatively, the ADF 400 is moved up so that the original is placed on an exposure glass 32 of the scanner 300, and then the ADF 400 is moved down to press the original to the exposure glass 32.

When a start switch (not shown) is pressed, the copy operation is started. If an original has been placed on the original tray 30, the original is conveyed to the exposure glass 32, and then the scanner 300 is immediately driven so that a first reciprocating member 33 and a second reciprocating member 34 are moved. If the original is placed on the exposure glass 32, the scanner 300 is immediately driven so that the first reciprocating member 33 and the second reciprocating member 34 are moved. A light is emitted from a light source included in the first reciprocating member 33 and then reflected by the surface of the original toward the second reciprocating member 34. The light is then reflected by a mirror included in the second reciprocating member 34 so that the light enters a read sensor 36 via an imaging lens 35, whereby images of the original are read by the read sensor 36.

When the copy operation is started, the intermediate transfer belt 10 is rotated and at the same time the photosensitive elements 40 are rotated in the image forming units 18 so that monochromatic images corresponding to black, yellow, magenta, and cyan are formed on the respective photosensitive elements 40. The monochromatic images are sequentially transferred onto the intermediate transfer belt 10 in a superimposed manner in accordance with the movement of the intermediate transfer belt 10, whereby a full-color image is formed on the intermediate transfer belt 10.

One of feed rollers 42 included in the feed unit 200 is selectively rotated due to the start of the copy operation so that transfer sheets are fed from one of a plurality of feed cassettes 44 arranged in a paper bank 43. The transfer sheets are then separated by a separation roller 45 one by one, and the separated transfer sheet is conveyed to a feed path 46. The transfer sheet is then conveyed to a feed path 48 arranged within the printer unit 100 by a sheet conveying roller 47 and stopped by registration rollers 49 such that the end of the transfer sheet is brought into contact with the registration rollers 49. If a manual feed operation is selected by the user, a manual feed roller 50 is rotated to feed transfer sheets from a manual feed tray 51, separated by a manual-feed separation roller 52 one by one, conveyed to a manual feed path 53, and then stopped by the registration rollers 49 in the same manner as described above.

The registration rollers 49 are rotated in synchronization with the full-color image formed on the intermediate transfer belt 10 so that a transfer sheet is conveyed to a secondary transfer area between the intermediate transfer belt 10 and the secondary transfer unit 22. The full-color image is then collectively transferred onto the transfer sheet by the secondary transfer unit 22, whereby the full-color image is recorded on the transfer sheet.

After the full-color image is transferred onto the transfer sheet on the secondary transfer area, the transfer sheet is conveyed to the fixing unit 25 by the secondary transfer unit 22. After the fixing unit 25 fixes the full-color image to the transfer sheet using heat and pressure, a switching claw 55 switches a conveying path for conveying the transfer sheet so that the transfer sheet is discharged out of the copier 500 by a discharge roller 26 and then stacked on a discharge tray 27. Alternatively, the switching claw 55 switches the conveying path so that the transfer sheet is conveyed to the transfer-sheet turnover unit 28. The transfer sheet is turned over by the transfer-sheet turnover unit 28 and then conveyed to the registration rollers 49 again. After the full-color image is transferred onto the back side of the transfer sheet on the secondary transfer area, the transfer sheet is discharged to the discharge tray 27 by the discharge roller 26.

After the full-color image is transferred onto the transfer sheet from the intermediate transfer belt 10 on the secondary transfer area, residual toner is removed from the intermediate transfer belt 10 by an intermediate-transfer member cleaning unit 17, and then the intermediate transfer belt 10 stands by for the next image forming operation to be performed by the tandem image forming unit 20.

As shown in FIG. 2, the image forming unit 18Y for yellow, the image forming unit 18M for magenta, the image forming unit 18C for cyan, and the image forming unit 18Bk for black, are arranged sequentially from the upstream side of the intermediate transfer belt 10 in the moving direction of the surface of the intermediate transfer belt 10. As shown in FIGS. 2 and 3, each of the image forming units 18 (18Y, 18M, 18C, 18Bk) includes the charging unit 56 (56Y, 56M, 56C, 56Bk), the developing unit 60 (60Y, 60M, 60C, 60Bk), the primary transfer unit 57 (57Y, 57M, 57C, 57Bk), the cleaning unit 58 (58Y, 58M, 58C, 58Bk), and the neutralizing unit 59 (59Y, 59M, 59C, 59Bk) that are arranged around the photosensitive element 40 (40Y, 40M, 40C, 40Bk).

Furthermore, as shown in FIG. 3, the developing unit 60 (60C and 60Bk) includes a developing roller 601 (601C and 601Bk) that is opposed to the photosensitive element 40 (40C and 40Bk). The developing roller 601 carries a two-component developer that contains toner and carriers and applies the toner to electrostatic latent images formed on the photosensitive element 40, thereby developing the electrostatic latent images. A developer container contains the developer to be supplied to the developing roller 601. The developer container includes a first screw 602 (602C and 602Bk) and a second screw 603 (603C and 603Bk) that are rotated to stir the developer while conveying the developer in the axial direction. The first screw 602 and the second screw 603 convey the developer in opposite directions to each other, so that the developer circulates in the developing unit 60. A toner density sensor 604 (604C and 604Bk) is located under the first screw 602. The toner density sensor 604 detects the toner density of the developer contained in the developing unit 60. The toner density sensor 604 is a magnetic permeability sensor.

As shown in FIG. 2, of the four image forming units 18, the image forming unit 18Bk is located at the most downstream side of the intermediate transfer belt 10 in the moving direction of the surface of the intermediate transfer belt 10. Such an arrangement makes it possible to shorten the first copy time, i.e., the time required for the first copy to be produced, in a Bk monochromatic mode by time corresponding to a movement distance of the intermediate transfer belt 10 between a photosensitive element 40Y for yellow arranged at the most upstream side and a photosensitive element 40Bk for black arranged at the most downstream side.

Figure 4:
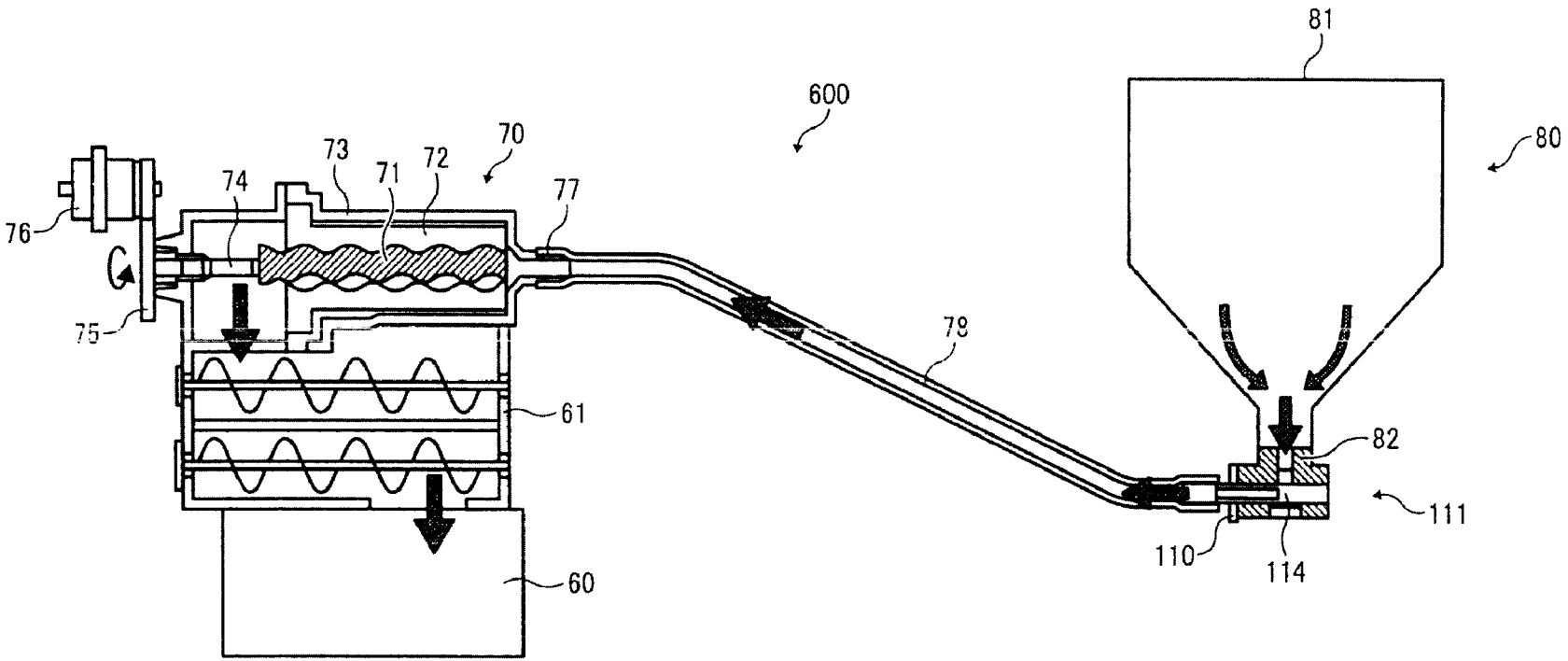
FIG. 4 is a schematic diagram of a toner feed unit included in the copier.

FIG. 4 is a schematic diagram of a toner feed unit 600 included in the copier 500. The toner feed unit 600 includes a toner container 80 (first toner container) that functions as a toner cartridge, a container fixing section 111 to which the toner container 80 is fixed, a powder pump 70 that pumps toner from a toner bag 81 of the toner container 80, and a sub-hopper 61 that is filled with the toner pumped by the powder pump 70 and conveys the toner to the developing unit 60.

The toner container 80 contains toner to be supplied to the developing unit 60. The toner container 80 is placed in an installation area (not shown) arranged in the printer unit 100. The installation area is exposed to the outside if a front cover (not shown) arranged on the outer side of the printer unit 100 is opened. The container fixing section 111 that forms part of the toner feed unit 600 is arranged in the installation area. A nozzle 110 is arranged in the container fixing section 111. The nozzle 110 is communicated with the powder pump 70 via a toner transfer tube 78 that functions as a toner supply path. When the toner container 80 is placed in the installation area, a base member 82 of the toner container 80 is inserted into an opening of the container fixing section 111 so that the toner container 80 is fixed to the container fixing section 111. Thus, the nozzle 110 is inserted into and connected to the base member 82. A path 114 is arranged inside the nozzle 110. The path is communicated with the toner transfer tube 78 that is connected to the end of the nozzle 110.

The toner container 80 includes the flexible and deformable toner bag 81. The toner bag 81 is a pouched container that has a single-layer or multi-layer structure and it is made from a flexible sheet material (having a thickness of about 80 μm to about 200 μm) such as a polyester film or a polyethylene film. The base member 82 is fixed to a lower middle portion of the toner bag 81. The base member 82 has a single toner discharge section. The toner bag 81 is tapered toward a toner discharge opening so that the toner does not easily remain in the toner bag 81.

Figure 5:
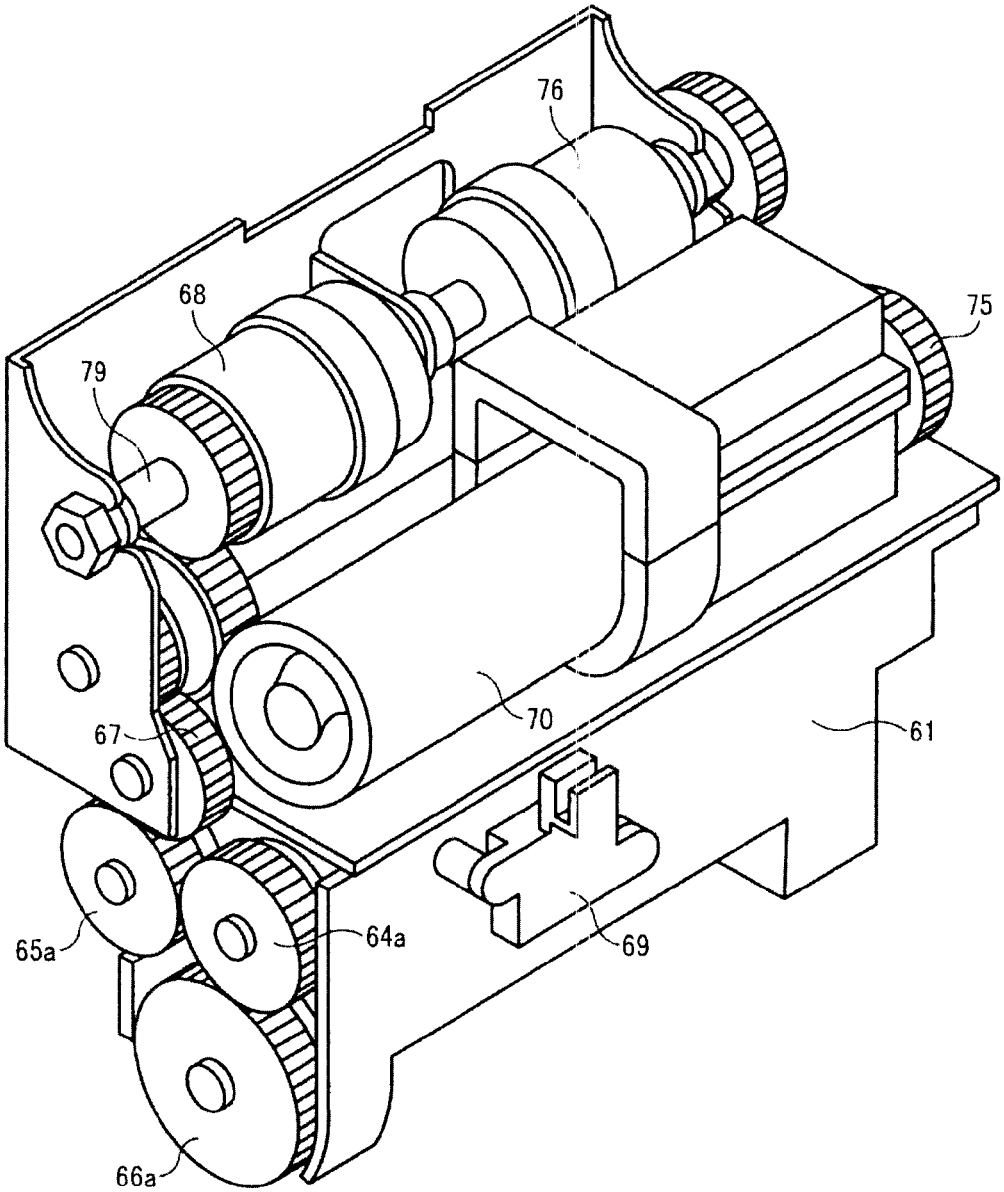
FIG. 5 is a perspective view of a sub-hopper and a powder pump included in the toner feed unit.

FIG. 5 is a perspective view of the sub-hopper 61 and the powder pump 70.

As shown in FIG. 4, the sub-hopper 61 that functions as a toner sub-container (second toner container) is located above the developing unit 60 to which toner is to be supplied. The toner contained in the toner container 80 is temporarily stored in the sub-hopper 61. The powder pump 70 is located above the sub-hopper 61. The powder pump 70 that functions as a screw pump unit is located above the sub-hopper 61. The powder pump 70 conveys toner contained in the toner container 80 to the sub-hopper 61. The powder pump 70 is a uniaxially eccentric screw pump. The powder pump 70 includes a rotor 71, a stator 72, and a folder 73. The rotor 71 is formed into a shape of an eccentric screw by using a rigid material, such as metal. The stator 72 is made of an elastic material, such as rubber, and is formed into a shape of a double-threaded screw. The folder 73 is made of a resin material, or the like. The folder 73 accommodates the rotor 71 and the stator 72 and forms a path for supplying powder. A drive shaft 74 is connected to the rotor 71 via a pin joint, and a gear 75 is integrally connected to the drive shaft 74. The gear 75 is connected to a first clutch 76 so as to be driven via an idle gear (not shown). The first clutch 76 is engaged or disengaged so that the operation of the powder pump 70 is controlled. The first clutch 76 and a second clutch 68 are arranged around a rotary drive shaft 79 that is driven by a drive unit (not shown).

A toner transfer section 77 is arranged at the end (the right end of the folder 73 as shown in FIG. 4) of the folder 73. A toner transfer tube 78 is connected to the toner transfer section 77. It is effective to use, as the toner transfer tube 78, a flexible tube that has a diameter of, for example, 4 millimeters (mm) to 10 mm and is made of rubber (for example, polyurethane, nitrile, ethylene propylene diene monomer (EPDM), silicon, or the like) with superior resistance to toner. A flexible tube is advantageous in that it can be easily installed from any direction.

Figure 6:
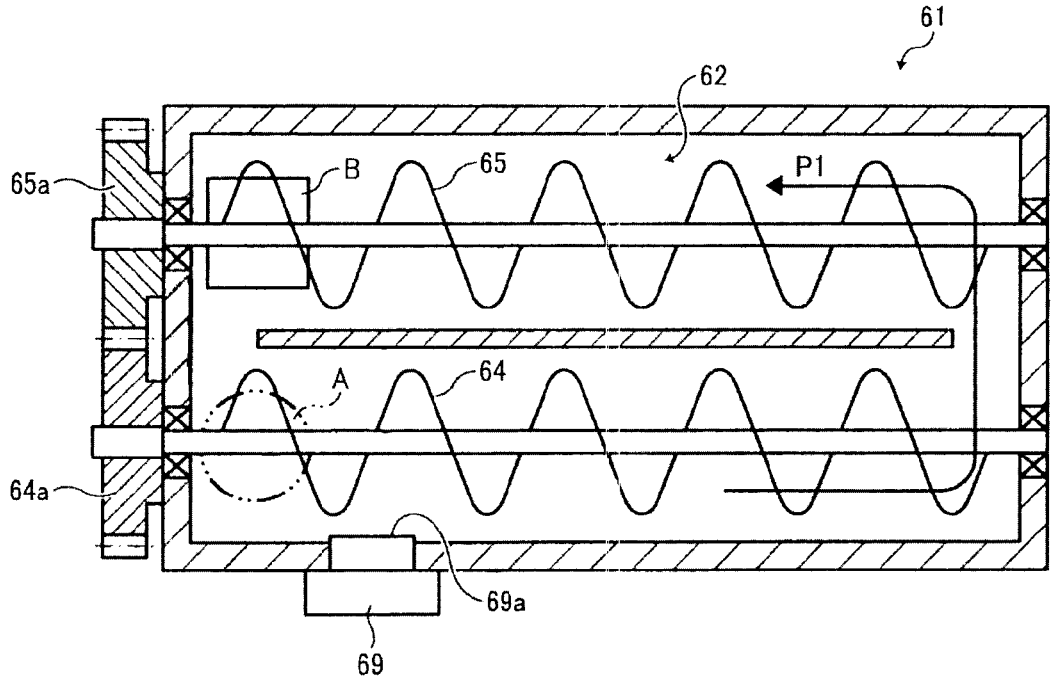
FIG. 6 is a cross-sectional view of an upper chamber of the sub-hopper as viewed from above.
Figure 7:
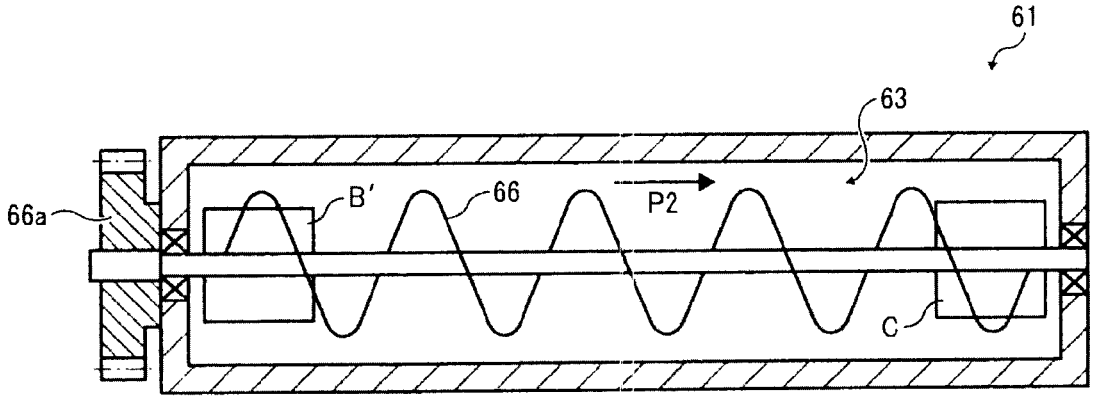
FIG. 7 is a cross-sectional view of a lower chamber of the sub-hopper as viewed from above.

The sub-hopper 61 is formed into a substantially inverted triangle in longitudinal section. The inside of the sub-hopper 61 is divided into two sections, i.e., an upper chamber 62 and a lower chamber 63, in the longitudinal direction. FIG. 6 is a cross-sectional view of the upper chamber 62 as viewed from above, and FIG. 7 is a cross-sectional view of the lower chamber 63 as viewed from above. As shown in FIG. 6, a pair of upper screws, i.e., a first upper screw 64 and a second upper screw 65, and a partition plate are arranged in the upper chamber 62. The upper chamber 62 has a larger floor space than the lower chamber 63. The partition plate is arranged between the first upper screw 64 and the second upper screw 65, and both ends of the partition plate are removed. A position indicated with the reference mark A in the upper chamber 62 is a supply position from which the toner conveyed by the powder pump 70 is supplied. The toner supplied to the position A is moved by the rotation of the first upper screw 64 and the second upper screw 65 in the direction indicated by an arrow P1 shown in FIG. 6. A hole indicated with the reference mark B is a communication hole through which the upper chamber 62 and the lower chamber 63 are communicated with each other. The toner moved in the direction indicated by the arrow P1 by the rotation of the first upper screw 64 and the second upper screw 65 are dropped down to the lower chamber 63 through the communication hole B.

As shown in FIG. 7, a lower screw 66 is arranged in the lower chamber 63. The toner supplied to a position indicated with the reference mark B' through the communication hole B is moved in the direction indicated by an arrow P2 shown in FIG. 7. The toner is moved by the rotation of the lower screw 66. A hole indicated with the reference mark C is a supply hole through which the lower chamber 63 and the developing unit 60 are communicated with each other. The toner moved in the direction indicated by the arrow P2 is dropped down to the developing unit 60 through the supply hole C so that the toner is supplied to the developing unit 60.

The toner supplied by the powder pump 70 is temporarily stored in the sub-hopper 61, and then transferred to the developing unit 60 by the upper screws 64 and 65 and the lower screw 66. Thus, the upper screws 64 and 65 and the lower screw 66 form a toner transfer unit in the sub-hopper 61. A gear 64*a* of the first upper screw 64, a gear 65*a* of the second upper screw 65, and a gear 66*a* of the lower screw 66 are connected to the second clutch 68 so as to be driven via an idle gear string 67, and the second clutch 68 is engaged or disengaged so that the operations of the upper screws 64 and 65 and the lower screw 66 are controlled.

A toner sensor 69 is located on the side wall of the sub-hopper 61 near the position A. The toner sensor 69 functions as a toner detecting unit that detects whether an amount of toner contained in the sub-hopper 61 is equal to or more than a predetermined amount at a detection position. The toner sensor 69 is an oscillating sensor. The toner sensor 69 detects whether the amount of toner is equal to or more than the predetermined amount at a detection surface 69*a* that is in contact with the toner contained in the upper chamber 62.

In the toner feed unit 600, when a control unit (not shown) issues a toner supply instruction to the developing unit 60 in accordance with a detection result of the toner density sensor 604, the second clutch 68 is engaged so that the upper screws 64 and 65 and the lower screw 66 are rotated. When the upper screws 64 and 65 and the lower screw 66 are rotated, an amount of toner corresponding to the rotation time of the upper screws 64 and 65 and the lower screw 66 is supplied to the developing unit 60.

The toner contained in the sub-hopper 61 is supplied to the developing unit 60 due to the rotation of the upper screws 64 and 65 and the lower screw 66; therefore, the sub-hopper 61 functions as a toner supply unit. Furthermore, because the upper screws 64 and 65 and the lower screw 66 are rotated when the second clutch 68 is engaged and the rotation of the upper screws 64 and 65 and the lower screw 66 is stopped when the second clutch 68 is disengaged, a toner-supply control unit 310 controls the operation for supplying toner to the developing unit 60 by engaging or disengaging the second clutch 68.

The toner sensor 69 monitors the amount of toner contained in the sub-hopper 61. If the amount of toner detected by the toner sensor 69 is lower than a predetermined amount, the control unit issues a toner filling instruction so that the powder pump 70 is operated. When the powder pump 70 is operated, a negative pressure is generated inside the powder pump 70, whereby toner is transferred from the toner container 80 to the powder pump 70, and the toner is supplied from the powder pump 70 to the sub-hopper 61. It is not necessary to control the amount of toner to be supplied to the sub-hopper 61 with high precision. The amount of toner to be transferred by the powder pump 70 for any given period is set to be larger than the amount of toner to be supplied to the developing unit 60 for the given period by the rotation of the upper screws 64 and 65 and the lower screw 66.

The sub-hopper 61 is filled with the toner fed from the toner container 80 due to the operation of the powder pump 70; therefore, the powder pump 70 functions as a toner filling unit. A toner-filling control unit 410 controls the operation for filling the sub-hopper 61 with toner by turning the powder pump 70 on and off.

Because the toner bag 81 is a flexible container, the volume of the toner bag 81 is automatically reduced in accordance with the toner supply operation performed by the powder pump 70.

In the toner feed unit 600, if the amount of toner detected by the toner sensor 69 is still lower than the predetermined amount even though the powder pump 70 is operated several times in accordance with toner filling instructions issued in accordance with a detection result of the toner sensor 69, it is determined that the toner container 80 contains hardly any toner, i.e., toner near end. If it is determined as the toner near end, for example, a message for cartridge replacement is displayed on a liquid crystal panel (not shown) of an operation unit. If the toner container 80 is not replaced with a new one, image forming operations are stopped after the image forming operation is performed a predetermined number of times.

A detection-surface cleaning member (not shown) is attached to a shaft of the first upper screw 64 at a position where the shaft is opposed to the detection surface 69*a*. The detection-surface cleaning member removes toner from the detection surface 69*a* so that the toner is prevented from continuously adhering to the detection surface 69*a*. The detection-surface cleaning member is an elastic sheet-like member fixed to the shaft of the first upper screw 64. The detection-surface cleaning member slides on the detection surface 69*a* by the rotation of the first upper screw 64, whereby the detection-surface cleaning member removes the toner from the detection surface 69*a*. If the toner continuously adheres to the detection surface 69*a*, the toner sensor 69 senses the toner adhering to the detection surface 69*a* and erroneously detects that the amount of toner contained in the sub-hopper 61 is equal to or more than the predetermined amount although the amount of toner contained in the sub-hopper 61 is actually lower than the predetermined amount. As a result, there is a possibility that an operation for filling the sub-hopper 61 with toner fed from the toner container 80 is not performed although the sub-hopper 61 needs to be filled with toner. If the amount of toner contained in the sub-hopper 61 is lower than the predetermined amount even though the operation for supplying toner from the sub-hopper 61 to the developing unit 60 is performed, a sufficient amount of toner cannot be supplied to the developing unit 60. As a result, the toner density of the developer contained in the developing unit 60 is decreased. If the toner density of the developer contained in the developing unit 60 is decreased, the density of images obtained by developing latent images formed on the photosensitive element 40 is decreased. In the sub-hopper 61, the detection-surface cleaning member removes toner from the detection surface 69*a* thereby preventing the toner from continuously adhering to the detection surface 69*a* so that it is possible to prevent the erroneous detection of the amount of toner contained in the sub-hopper 61 as being equal to or more than the predetermined amount although the amount of toner contained in the sub-hopper 61 is actually lower than the predetermined amount. Thus, it is possible to prevent the decrease in the image density that is caused due to an insufficient amount of toner supplied from the sub-hopper 61 to the developing unit 60. The detection-surface cleaning member is not necessarily a sheet-like member fixed to the shaft of the first upper screw 64. The detection-surface cleaning member can be any member as long as it can remove toner from the detection surface 69*a*.

Figure 8:
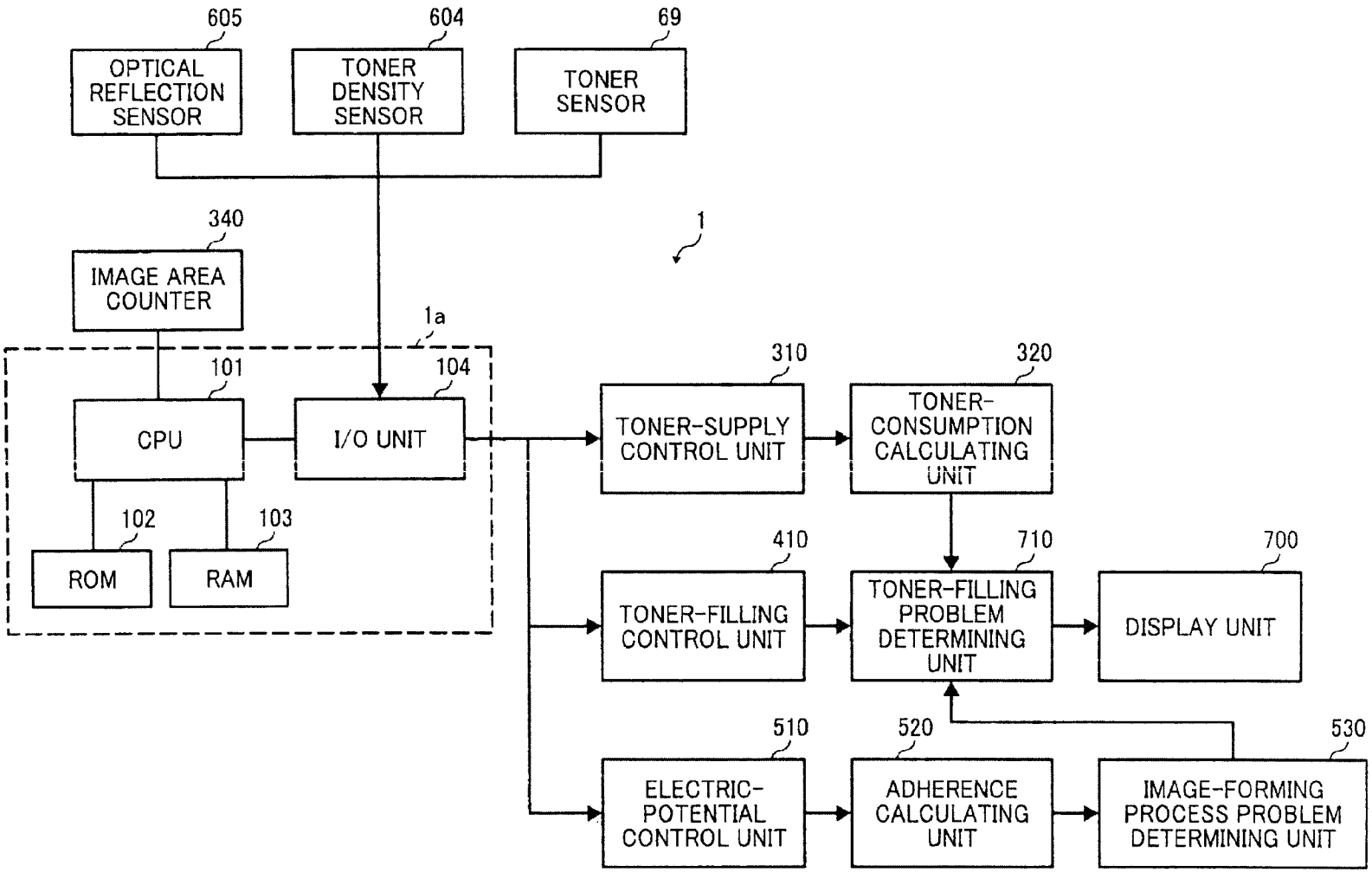
FIG. 8 is a block diagram of a control unit of the copier.

FIG. 8 is a block diagram of a control unit 1 of the copier 500. The control unit 1 is arranged for each of the four image forming units 18. Because the basic configurations of the control units 1 are the same, the configuration of the control unit 1 will be explained with reference marks Y, C, M, and Bk omitted. A main part indicated with the reference mark la shown in FIG. 8 of the control unit 1 is shared by the four image forming units 18. The main part 1*a* includes a central processing unit (CPU) 101, a read-only memory (ROM) 102, a random access memory (RAM) 103, and an I/O unit 104.

The optical reflection sensor 605 is connected to the control unit 1. The control unit 1 includes an electric-potential control unit 510, an adherence calculating unit 520, and an image-forming process problem determining unit 530. The adherence calculating unit 520 functions as a toner-adherence calculating unit that calculates the amount of toner adhering to an adherence control pattern in accordance with a detection result of the optical reflection sensor 605. The control unit 1 functions as an image-density control unit that controls image density by optimizing an image forming condition in accordance with the amount of toner adherence calculated by the adherence calculating unit 520. If the amount of toner adherence calculated by the adherence calculating unit 520 is not a desired amount of toner adherence, the control unit 1 adjusts an image forming condition of an image forming process. The image forming condition is, for example, the electric potential of the photosensitive element 40 uniformly charged by the charging unit 56, the developing bias applied to the developing roller 601, the optical writing intensity with which the exposure unit 21 writes images on the photosensitive element 40, or the control target value of toner density of a developer. Thus, the density of images to be formed can be controlled. Moreover, the image-forming process problem determining unit 530 functions as a problem-occurrence determining unit that determines that a problem occurs at some stage of the image forming process if the amount of toner adherence calculated by the adherence calculating unit 520 falls outside a predetermined range.

The control unit 1 includes the toner-filling control unit 410 that controls an operation for filling the sub-hopper 61 with toner in accordance with a detection result of the toner sensor 69. The toner-filling control unit 410 also calculates and stores an accumulated toner-filling amount. If the toner sensor 69 detects "no toner", the toner-filling control unit 410 engages the first clutch 76. The powder pump 70 is then operated so that the sub-hopper 61 is filled with toner fed from the toner container 80. If the toner sensor 69 detects "toner filled", the toner-filling control unit 410 disengages the first clutch 76, thereby terminating the toner filling operation.

The control unit 1 further includes the toner-supply control unit 310 that controls an operation for supplying toner from the sub-hopper 61 to the developing unit 60 so that the toner is supplied to the developing unit 60 if necessary. The toner-supply control unit 310 also calculates and stores an accumulated toner-supply amount. If it is detected in accordance with a detection result of the toner density sensor 604 that the toner density of the developer contained in the developing unit 60 is decreased, the toner-supply control unit 310 engages the second clutch 68. Thus, each of the upper screws 64 and 65 and the lower screw 66 is rotated so that the toner is supplied from the sub-hopper 61 to the developing unit 60.

The control unit 1 includes an image area counter 340 that calculates an image area per one image and functions as an image-area calculating unit. The image area is obtained by counting an image area of an image written on the photosensitive element 40 using image data sent from the control unit 1 to the exposure unit 21.

The control unit 1 further includes a toner-filling problem determining unit 710 that functions as a problem-occurrence area determining unit. If the image-forming process problem determining unit 530 determines that a problem has occurred at some stage of the image forming process, the toner-filling problem determining unit 710 determines whether the problem is caused by a toner filling operation on the basis of toner filling data from the toner-filling control unit 410 and toner supply data from the toner-supply control unit 310.

The control unit 1 is connected to a display unit 700 that functions as a notifying unit. If the image-forming process problem determining unit 530 determines that a problem has occurred, the display unit 700 displays that a problem has occurred, thereby notifying a user or maintenance personnel of the occurrence of a problem. If the toner-filling problem determining unit 710 determines that the problem is caused by the toner filling operation, the display unit 700 notifies the user or maintenance personnel that the problem is caused by the toner filling operation.

The I/O unit 104 is connected to the toner density sensor 604, the toner sensor 69, and the optical reflection sensor 605 via respective analog/digital (A/D) converters (not shown). The CPU 101 executes a predetermined toner-density control program so that the control unit 1 sends a control signal to the toner feed unit 600 via the I/O unit 104, thereby controlling the toner supply operation. Furthermore, the CPU 101 executes a predetermined target output-value correction program so that a target output value of the toner density sensor 604 is corrected on the basis of a detection result of the optical reflection sensor 605 for each image forming operation (print job), whereby a constant image density can always be obtained. The toner-density control program, the target output-value correction program, and the like, are stored in the ROM 102. The RAM 103 includes a Vt register, a $Vt_{ref}$ register, and a Vs register. The Vt register temporarily stores therein an output value Vt of the toner density sensor 604 that is obtained via the I/O unit 104. The $Vt_{ref}$ register stores therein a target output value $Vt_{ref}$ that is a toner-density control reference value to be output from the toner density sensor 604 if the toner density of the developer contained in the developing unit 60 is a target toner density. The Vs register stores therein an output value Vs of the optical reflection sensor 605. The toner supply operation is performed in accordance with a difference value Tn between the output value Vt and the target output value $Vt_{ref}$, i.e., $Tn=Vt_{ref}-Vt$. If the difference value Tn is positive, it is determined that the toner density is sufficiently high and the toner supply operation is not performed. Conversely, if the difference value Tn is negative, the toner supply operation is performed. The amount of toner supplied is directly proportional to the absolute value of the difference value Tn so that the output value Vt approaches the target output value $Vt_{ref}$. The adherence control pattern to be detected by the optical reflection sensor 605 is a reference toner image with a predetermined shape formed on the intermediate transfer belt 10 between images corresponding to respective sheets formed on the intermediate transfer belt 10.

In the copier 500, the adherence control pattern is detected by the control unit 1 and the optical reflection sensor 605. If a problem occurs in an image forming process, the adherence control pattern is not correctly formed; therefore, the problem is detected on the basis of a detection result of the optical reflection sensor 605.

Figure 9:
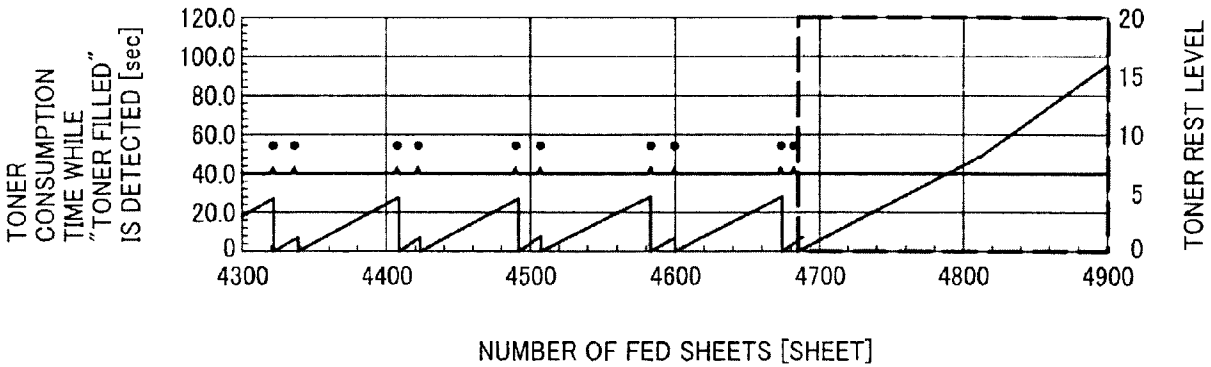
FIG. 9 is a graph that indicates a timing in which a toner sensor shown in FIG. 5 detects "no toner", a timing in which a toner filling operation is performed, and an integrated value of time during which a second clutch shown in FIG. 5 is continuously engaged.

FIG. 9 is a graph that indicates a timing (plotted with black circles) in which the toner sensor 69 detects "no toner" and a timing (plotted with black triangles) in which a toner filling operation is performed. The horizontal axis indicates the number of fed sheets. A diagonal line shown in FIG. 9 indicates an integrated value of time (feed time) during which the second clutch 68 that is a sub-hopper clutch is continuously engaged immediately after the toner filling operation is performed. The integrated value is reset when the toner sensor 69 detects "no toner" (plotted with black circles).

In the sheet feed operation shown in FIG. 9, the toner sensor 69 detects "no toner" in the sub-hopper 61 for every 100 sheets until the number of fed sheets reaches about 4,700 sheets. The toner sensor 69 detects "no toner" (plotted with a black circle) at about the 10th sheet after the toner filling operation is performed. This is because the toner sensor 69 detects "toner filled" due to an unstable volume of the toner filled during the first toner filling operation and then detects "no toner" again at about the 10th sheet when the volume of the toner becomes stable.

In the sheet feed operation shown in FIG. 9, because the detection-surface cleaning member is damaged after about the 4,700th sheet, the toner continuously adheres to the detection surface 69*a* and therefore the toner sensor 69 always detects "toner filled" (no more black circles are plotted on the graph). The toner-filling control unit 410 performs the toner filling operation when the toner sensor 69 detects "no toner". Therefore, if hardware, such as the detection-surface cleaning member, is damaged, the toner-filling control unit 410 does not perform the toner filling operation (no more black triangles are plotted on the graph).

Figure 10:
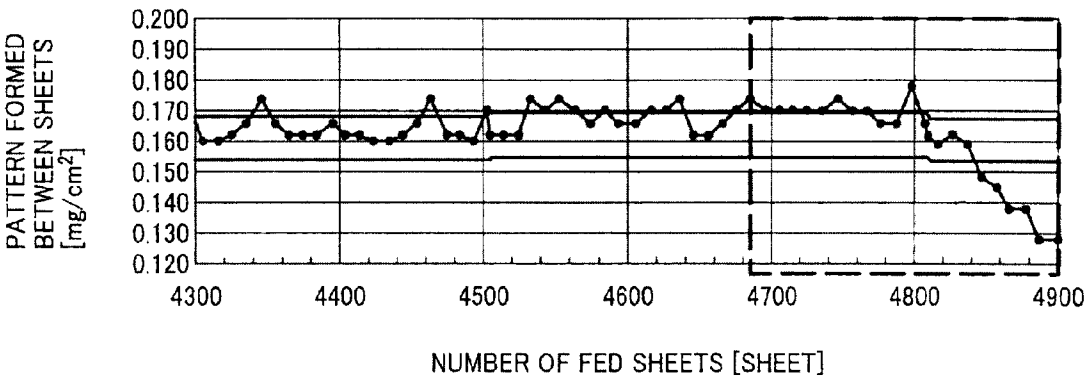
FIG. 10 is a graph that indicates calculation results of an amount of toner adherence in accordance with a detection result of an optical reflection sensor shown in FIG. 1.

FIG. 10 is a graph that indicates calculation results of the amount of toner adherence in accordance with the detection result of the optical reflection sensor 605 that detects the adherence control pattern formed between images corresponding to respective sheets formed on the intermediate transfer belt 10. The horizontal axis indicates the number of fed sheets, and the vertical axis indicates the amount of toner adhering to the adherence control pattern that is a solid image per unit area. Although sheets are continuously fed after about the 4,700th sheet is fed when the detection-surface cleaning member is damaged as described with reference to FIG. 9, the amount of toner adherence is rapidly decreased from around the 4,800th sheet, as shown in FIG. 10, when the sub-hopper 61 contains no toner to be supplied to the developing unit 60.

Because the amount of toner adherence is rapidly decreased after the 4,800th sheet, when the control unit 1 performs a process control in accordance with a detection result of the adherence control pattern, the image-forming process problem determining unit 530 determines that the amount of toner adherence falls outside a predetermined range, whereby it is possible to determine that a problem has occurred at some stage of the image forming process performed by the copier 500. In order to resolve the problem, it is necessary to analyze the cause of the problem. However, because there is a plurality of possible causes of the decrease in the amount of toner adherence equivalent to the number of combinations of image forming processes, it takes a long time for maintenance personnel to analyze the cause of the problem in a conventional image forming apparatus. More specifically, if it is determined that a problem has occurred at some stage of an image forming process, a notifying unit notifies the user of the occurrence of the problem. The user then calls maintenance personnel so that the maintenance personnel analyze the cause of the problem and repair the part of the image forming apparatus that has caused the problem. In a conventional image forming apparatus, the maintenance personnel need to examine whether a problem has occurred in every part of the image forming apparatus that can affect images of the adherence control pattern. Specifically, even if a problem has occurred in a toner filling process such that the detection-surface cleaning member is damaged, it is necessary to examine whether a problem has occurred in each member of an image forming unit, such as a developing unit, arranged around a photosensitive element. Therefore, it takes a long time for the maintenance personnel to determine that a problem has occurred in a toner filling process, resulting in a long downtime during which the maintenance personnel repair the image forming apparatus and the user cannot use the image forming apparatus.

In the copier 500, when the amount of toner adherence of the adherence control pattern is abnormally decreased, the toner-filling problem determining unit 710 determines whether a problem has occurred in the toner filling process separately from other image forming processes. If the image-forming process problem determining unit 530 determines that a problem has occurred at some stage of the image forming process, the toner-filling problem determining unit 710 determines whether a problem has occurred in the toner filling process and the display unit 700 notifies the user of the determination made by the toner-filling problem determining unit 710 so that it is possible to notify the user or the maintenance personnel whether the problem is caused by the toner filling process. Thus, the maintenance personnel need to examine whether the problem has occurred in only the toner filling process or any of the other image forming processes so that it is possible to shorten the time required to determine the part that has caused the problem and reduce the downtime compared to that of conventional image forming apparatuses.

The toner-supply control unit 310 includes a toner-consumption calculating unit 320 that calculates the accumulated toner consumption by accumulating toner consumptions after a previous toner filling operation is performed. When the image-forming process problem determining unit 530 determines that a problem has occurred in an image forming process, the toner-filling problem determining unit 710 determines that the problem is caused by the toner filling process if Inequality (A1) described below is not satisfied:

$$\text{Accumulated toner consumption} < \text{amount of toner contained in the sub-hopper when the toner filling operation is stopped} \quad \text{(A1)}$$

The accumulated toner consumption is calculated from data (plotted with the black triangles shown in FIG. 9) about a timing in which the previous toner filling operation is performed. The data is a part of toner-filling control data. The accumulated toner consumption is also calculated from data about the time during which the second clutch 68 is continuously engaged. The data is a part of toner-supply control data.

Figure 11:
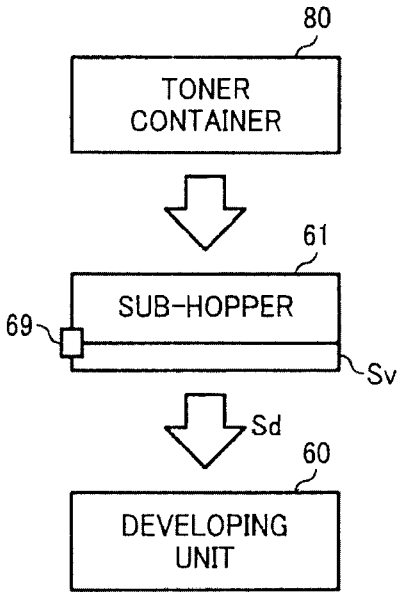
FIG. 11 is a schematic diagram that illustrates a first example of a problem-occurrence area determining unit shown in FIG. 8.

FIG. 11 is a schematic diagram that illustrates a first example of the problem-occurrence area determining unit.

The flow of toner in the copier 500 is indicated by an arrow shown in FIG. 11. If toner is not present at the position of the toner sensor 69 in the sub-hopper 61 and the toner sensor 69 detects "no toner", the toner-filling control unit 410 performs the toner filling operation so that the toner is supplied from the toner container 80 to the sub-hopper 61. If the sub-hopper 61 is filled with toner such that the toner is present at the position of the toner sensor 69 in the sub-hopper 61 and the toner sensor 69 detects "toner filled", the toner-filling control unit 410 terminates the toner filling operation. If it is detected that the toner density of the developer contained in the developing unit 60 is lower than a predetermined density in accordance with a detection result of the toner density sensor 604, the toner-supply control unit 310 performs the toner supply operation so that the toner is supplied from the sub-hopper 61 to the developing unit 60. In the toner supply operation, the toner-supply control unit 310 engages the second clutch 68 so that the upper screws 64 and 65 and the lower screw 66 are rotated, whereby the toner is supplied from the sub-hopper 61 to the developing unit 60. If the toner contained in the sub-hopper 61 is reduced due to the toner supply operation and the toner sensor 69 detects "no toner", the toner-filling control unit 410 performs the toner filling operation.

The right-hand side of Inequality (A1), i.e., "amount of toner contained in the sub-hopper when the toner filling operation is stopped", is defined as the amount of toner contained in the sub-hopper 61 in which the toner is present at a level such that the toner sensor 69 detects "toner filled" and is expressed as "sub-hopper volume Sv". The left-hand side of Inequality (A1), i.e., "accumulated toner consumption", is defined as the amount of toner supplied from the sub-hopper 61 to the developing unit 60 after the previous toner filling operation is terminated and is expressed as "accumulated toner-supply amount Sd". Inequality (A1) can be expressed as Inequality (1):

$$\text{Accumulated toner-supply amount } Sd < \text{sub-hopper volume } Sv \quad (1)$$

If the toner filling process is correctly performed, Inequality (1) is satisfied.

The accumulated toner-supply amount Sd is directly proportional to the time during which the second clutch 68 is continuously engaged. In the sheet feed operation experiment that produces the results shown in FIGS. 9 and 10, Inequality (1) is not satisfied using the counted time during which the second clutch 68 is continuously engaged after the 4,700th sheet is fed (the area indicated with a broken line shown in FIG. 9) when the detection-surface cleaning member is damaged as shown in FIG. 9. Dimensions of the left-hand side and the right-hand side of Inequality (1) are unified by using data on the supply capacity [g/sec] of the toner feed unit 600 as previously obtained by experiment. Specifically, the accumulated toner-supply amount Sd is calculated by previously obtaining, by experiment, a supply amount [g/sec] of toner supplied from the sub-hopper 61 to the developing unit 60 per hour when the second clutch 68 is engaged while the sub-hopper 61 contains a sufficient amount of toner, and then multiplying the supply amount by a value of the time during which the second clutch 68 is continuously engaged. The sub-hopper volume Sv is a fixed value obtained by measuring toner contained in the sub-hopper 61 when the toner sensor 69 detects "toner filled" and the toner filling operation is terminated.

As described above, when the amount of toner adherence of the adherence control pattern is decreased, it is determined whether Inequality (1) is satisfied so that it is possible to determine whether the toner filling process is correctly or incorrectly performed separately from other processes. Problems in the toner filling process are not limited to the damage of the detection-surface cleaning member. In another example, if the toner sensor 69 is damaged and continuously sends signals indicating "toner filled", Inequality (1) is not satisfied and it is possible to detect the occurrence of a problem in the toner filling process.

As described above, in the copier 500, the toner-filling problem determining unit 710 determines whether the toner filling process is being correctly or incorrectly performed using Inequality (1) separately from other processes. If Inequality (1) is not satisfied, the toner-filling problem determining unit 710 determines that a problem has occurred in the toner filling process, notifies the display unit 700 that the problem has occurred in the copier 500, and also notifies the display unit 700 that the problem has occurred in the toner filling process.

If a problem occurs in the toner filling process, the display unit 700 notifies maintenance personnel that a problem has occurred in the toner filling process. Therefore, the maintenance personnel can quickly determine that the problem has occurred in the toner filling process. If it is determined that the problem has occurred in the copier 500 in accordance with a detection result of the adherence control pattern, it is possible to reduce the downtime of the copier 500 until the problem of the copier 500 is resolved.

The display unit 700 is a liquid crystal panel that is operated by a user. The display unit 700 is not necessarily a liquid crystal panel. The display unit 700 can be anything as long as it can notify maintenance personnel that a problem occurs in the toner filling process. For example, the display unit 700 can be a lamp that is turned on when a problem occurs in the toner filling process.

Figure 12:
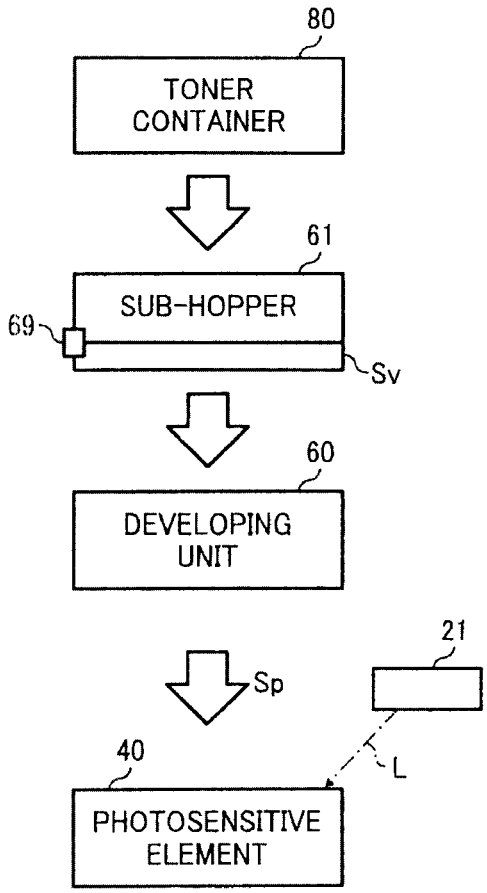
FIG. 12 is a schematic diagram that illustrates a second example of the problem-occurrence area determining unit.

FIG. 12 is a schematic diagram that illustrates a second example of the problem-occurrence area determining unit.

Because the configuration for supplying toner from the toner container 80 to the developing unit 60 via the sub-hopper 61 in the second example is the same as that in the first example, detailed explanation is omitted.

In the first example, it is determined whether there is a problem in the toner filling process by comparing the sub-hopper volume Sv and the accumulated toner-supply amount Sd. In the second example, it is determined whether there is a problem in the toner filling process by comparing the sub-hopper volume Sv and an accumulated toner development amount Sp, as the accumulated toner consumption, that is obtained by accumulating amounts of toner supplied to the photosensitive element 40 from the developing unit 60 and used for developing images on the photosensitive element 40 after the previous toner filling operation is performed. The accumulated toner development amount Sp is calculated by accumulating the toner consumption of one image from the end of the previous toner filling operation to the start of the next toner filling operation. The toner consumption of one image is calculated as a product of an image area per one image calculated by the image area counter 340 and a target adherence amount [mg/cm$^2$] for an electrostatic latent image per unit area as previously obtained by experiment. If the next toner filling operation is started, the accumulated toner development amount Sp is reset. The toner-consumption calculating unit 320 calculates, on the basis of an image area of one image, toner consumption of the image and accumulates the calculated toner consumption from the previous toner filling operation, thereby calculating the accumulated toner development amount Sp. Inequality (A1) can be expressed as Inequality (2):

$$\text{Accumulated toner development amount } Sp < \text{sub-hopper volume } Sv \quad (2)$$

If the toner supply process is correctly performed, Inequality (2) is satisfied.

As described above, when the amount of toner adherence of the adherence control pattern is decreased, it is determined whether Inequality (2) is satisfied, so that it is possible to determine whether the toner filling process is correctly or incorrectly performed separately from other processes in the same manner as in the first example.

As described above, the photosensitive element 40 carries electrostatic latent images, and the exposure unit 21 forms electrostatic latent images on the photosensitive element 40. The developing unit 60 forms toner images by applying toner to the electrostatic latent images formed on the photosensitive element 40. The toner container 80 contains toner to be supplied to the developing unit 60. The sub-hopper 61 is located along a toner conveying path for conveying toner from the toner container 80 to the developing unit 60. The sub-hopper 61 temporarily contains toner conveyed from the toner container 80 and feeds the toner to the developing unit 60. The toner-filling control unit 410 controls an operation (hereinafter, "toner filling operation") for supplying toner from the toner container 80 to the sub-hopper 61 so that the sub-hopper 61 contains toner equal to or more than a predetermined amount of toner. The toner-supply control unit 310 controls an operation (hereinafter, "toner supply operation") for supplying toner from the sub-hopper 61 to the developing unit 60 depending on the requirements of the developing unit 60. The optical reflection sensor 605 detects an adherence control pattern that is a reference toner image formed on the intermediate transfer belt 10 to which toner images are transferred from the photosensitive element 40. The control unit 1 controls image density by adjusting an image forming condition on the basis of a detection result of the optical reflection sensor 605. The image-forming process problem determining unit 530 determines whether a problem occurs at some stage of an image forming process in accordance with a detection result of the optical reflection sensor 605. If the image-forming process problem determining unit 530 determines that a problem has occurred at some stage of the image forming process, the toner-filling problem determining unit 710 determines whether the problem is caused by a toner filling process on the basis of toner filling data and toner supply data. The display unit 700 displays a determination result made by the toner-filling problem determining unit 710. If the image-forming process problem determining unit 530 determines that a problem has occurred at some stage of the image forming process, the toner-filling problem determining unit 710 determines whether the problem has occurred in the toner filling process and the display unit 700 displays a determination result made by the toner-filling problem determining unit 710 so that it is possible to notify a user or maintenance personnel whether the problem is caused by the toner filling process. Therefore, if the display unit 700 displays that the problem has occurred in the toner filling process, the maintenance personnel only need to analyze whether the operation for supplying toner from the toner container 80 to the sub-hopper 61 is being performed correctly or incorrectly. On the other hand, if the display unit 700 does not display that the problem has occurred in the toner filling process, the maintenance personnel do not need to analyze whether the toner filling operation is being performed correctly or incorrectly. Therefore, if a problem is detected in an image forming process on the basis of the adherence control pattern, it is possible to reduce the downtime caused until the problem is solved.

Furthermore, the toner-consumption calculating unit 320 calculates the amount of toner adhering to an adherence control pattern on the basis of the detection result of the optical reflection sensor 605. The image-forming process problem determining unit 530 determines that a problem has occurred at some stage of an image forming process if the amount of toner adhering to the adherence control pattern falls outside a predetermined range. Because a problem in the image forming process is detected by determining whether the amount of toner adherence used for image density control falls within a predetermined range, it is not necessary to arrange a detecting unit, such as a sensor, to determine whether a problem has occurred.

The toner sensor 69 detects whether the sub-hopper 61 contains toner equal to or more than a predetermined amount of toner. The powder pump 70 conveys toner from the toner container 80 to the sub-hopper 61 so that the sub-hopper 61 is filled with the toner. The sub-hopper 61 conveys toner contained in the sub-hopper 61 to the developing unit 60, thereby filling the developing unit 60 with the toner. If the toner sensor 69 detects that an amount of toner contained in the sub-hopper 61 is less than a predetermined amount, the toner-filling control unit 410 causes the powder pump 70 to perform the toner filling operation. If the toner sensor 69 detects that an amount of toner contained in the sub-hopper 61 is equal to or more than a predetermined amount, the toner-filling control unit 410 causes the powder pump 70 to stop the toner filling operation. The toner-consumption calculating unit 320 calculates the accumulated toner consumption by accumulating toner consumptions after a previous toner filling operation is performed. When the image-forming process problem determining unit 530 determines that there is a problem at some stage of an image forming process, the toner-filling problem determining unit 710 determines that the problem is caused by a toner filling process if the accumulated toner consumption calculated from toner-filling control data and toner-supply control data does not satisfy Inequality (A1).

It is determined whether Inequality (A1) is satisfied so that it is possible to determine whether a problem has occurred in the toner filling process on the basis of the toner-filling control data and the toner-supply control data.

Furthermore, the accumulated toner-supply amount Sd calculated on the basis of the operation time of the powder pump 70 after the previous toner filling operation is performed is used as the accumulated toner consumption so that it is possible to compare the accumulated toner consumption with the sub-hopper volume Sv.

Moreover, the image area counter 340 calculates the area of electrostatic latent images formed on the photosensitive element 40. The accumulated toner development amount Sp calculated on the basis of accumulated image areas after the previous toner filling operation is performed is used as the accumulated toner consumption so that it is possible to compare the accumulated toner consumption with the sub-hopper volume Sv.

According to an aspect of the present invention, it is possible to reduce the downtime of an image forming apparatus until a problem that has occurred in the image forming apparatus is solved.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An image forming apparatus comprising:

a latent image carrier configured to carry an electrostatic latent image;

a latent-image forming unit configured to form an electrostatic latent image on the latent image carrier;

a developing unit configured to develop the electrostatic latent image formed on the latent image carrier into a toner image by applying toner to the electrostatic latent image;

a first toner container configured to contain therein toner to be supplied to the developing unit;

a second toner container that is located along a toner conveying path for conveying toner from the first toner container to the developing unit, wherein the second toner container temporarily holds toner conveyed from the first toner container and feeds the toner to the developing unit;

a toner-filling control unit configured to control a toner filling operation for supplying toner from the first toner container to the second toner container so that the second toner container contains toner equal to or more than a predetermined amount of toner;

a toner-supply control unit configured to control a toner supply operation for supplying toner from the second toner container to the developing unit depending on requirements of the developing unit;

a reference toner-image detecting unit configured to detect a reference toner image that is a toner image with a predetermined shape formed on any one of the latent image carrier and an image carrier to which the toner image is transferred from the latent image carrier;

an image-density control unit configured to control image density by adjusting an image forming condition in accordance with a detection result obtained from the reference toner-image detecting unit;

a problem-occurrence determining unit configured to determine whether a problem occurs at some stage of an image forming process in accordance with the detection result;

a toner-consumption calculating unit configured to calculate accumulated toner consumption by accumulating toner consumption after a previous toner filling operation is stopped;

a problem-occurrence area determining unit configured to, if the problem-occurrence determining unit determines that the problem has occurred, determine that the problem is caused by the toner filling operation if the accumulated toner consumption calculated by the toner-consumption calculating unit is larger than an amount of toner contained in the second toner container when the previous toner filling operation is stopped; and a notifying unit configured to notify a determination obtained by the problem-occurrence area determining unit as to whether the problem is caused by the toner filling operation.

2. The image forming apparatus according to claim 1, further comprising a toner-adherence calculating unit configured to calculate an amount of toner adhering to the reference toner image on the basis of the reference toner image detected by the reference toner-image detecting unit, wherein the problem-occurrence determining unit determines that the problem has occurred at some stage of the image forming process if the amount of toner adhering to the reference toner image falls outside a predetermined range.

3. The image forming apparatus according to claim 1, further comprising:

a toner filling-amount detecting unit configured to detect whether the second toner container contains toner equal to or more than a predetermined amount of toner;

a toner filling unit configured to supply toner to the second toner container by conveying toner from the first toner container to the second toner container; and a toner supply unit configured to supply toner to the developing unit by conveying toner from the second toner container to the developing unit, wherein the toner-filling control unit causes the toner filling unit to perform the toner filling operation if the toner filling-amount detecting unit detects that an amount of toner contained in the second toner container is less than the predetermined amount and causes the toner filling unit to stop the toner filling operation if the toner filling-amount detecting unit detects that the amount of toner contained in the second toner container is equal to or more than the predetermined amount.

4. The image forming apparatus according to claim 1, wherein the accumulated toner consumption is calculated on the basis of an operation time of the toner supply unit after the previous toner filling operation is performed.

5. The image forming apparatus according to claim 1, further comprising an image-area calculating unit configured to calculate an area of an electrostatic latent image formed on the latent image carrier, wherein the accumulated toner consumption is calculated on the basis of an accumulated image area calculated by the image-area calculating unit after the previous toner filling operation is performed.

* * * * *